US006446712B1

(12) United States Patent
Wu et al.

(10) Patent No.: US 6,446,712 B1
(45) Date of Patent: Sep. 10, 2002

(54) RADIAL FLOW ANNULAR HEAT EXCHANGERS

(75) Inventors: Alan K. Wu, Kitchener; Bruce L. Evans, Burlington, both of (CA); Henri P. T. van Helden, Beverley Hills, MI (US)

(73) Assignee: Long Manufacturing Ltd.

( * ) Notice: Subject to any disclaimer, the term of this patent is extended or adjusted under 35 U.S.C. 154(b) by 0 days.

(21) Appl. No.: 09/255,883

(22) Filed: Feb. 23, 1999

(51) Int. Cl.[7] ..... F28F 3/04; F28F 3/08
(52) U.S. Cl. ..... 165/167; 165/916
(58) Field of Search ..... 165/167, 916

(56) References Cited

U.S. PATENT DOCUMENTS

| | | | | |
|---|---|---|---|---|
| 3,743,011 A | | 7/1973 | Frost | 165/167 X |
| 4,271,901 A | * | 6/1981 | Buchmuller | 165/916 X |
| 4,742,866 A | * | 5/1988 | Yamanaka et al. | 165/167 X |
| 4,967,835 A | | 11/1990 | Lefeber | |
| 5,014,775 A | | 5/1991 | Watanabe | 165/167 |
| 5,078,209 A | * | 1/1992 | Kerkman et al. | 165/167 |
| 5,179,999 A | * | 1/1993 | Meekins et al. | 165/167 X |
| 5,203,832 A | * | 4/1993 | Beatenbough et al. | 165/167 X |
| 5,406,910 A | | 4/1995 | Wallin | |
| 5,797,450 A | * | 8/1998 | Kawabe et al. | 165/167 X |

FOREIGN PATENT DOCUMENTS

| | | | |
|---|---|---|---|
| JP | 4-356686 | * 12/1992 | 165/916 |
| JP | 6-173626 | * 6/1994 | 165/916 |
| WO | 44305 | 10/1998 | |

* cited by examiner

*Primary Examiner*—Leonard Leo
(74) *Attorney, Agent, or Firm*—Young & Basile

(57) ABSTRACT

A heat exchanger and method of transferring heat between fluids is disclosed using a plurality of stacked plate pairs consisting of face-to-face, mating, ringlike plates, each plate having an outer peripheral flange, an annular inner boss located in a common plane with the peripheral flange, and an offset intermediate area located between the peripheral flange and the inner boss. The peripheral flanges and inner bosses in the mating plates are joined together. The intermediate areas have outwardly disposed joined intermediate bosses having aligned inlet and outlet openings forming manifolds for the flow of a first heat exchange fluid circumferentially through the plate pairs from the inlet manifold to the outlet manifold. The heat exchanger also has a header enclosing either the inner bosses or the outer peripheral flanges to cause all of a second heat exchange fluid to pass between the plate pairs transversely relative to the flow of the first heat exchange fluid. Flow augmentation means, such as ribs and grooves, dimples or turbulizers can be used inside or between the plate pairs, if desired.

24 Claims, 11 Drawing Sheets

RADIAL FLOW ANNULAR HEAT EXCHANGERS

BACKGROUND OF THE INVENTION

This invention relates to heat exchangers, and in particular, to oil coolers of the so called "doughnut" type that can be used separately or in conjunction with oil filters in automotive and other engine and transmission cooling applications.

Oil coolers have been made in the past out of a plurality of stacked plate pairs located in a housing or canister. The canister usually has inlet and outlet fittings for the flow of engine coolant into and out of the canister circulating around the plate pairs. The plate pairs themselves have inlet and outlet openings and these openings are usually aligned to form manifolds, so that the oil passes through all of the plate pairs simultaneously. These manifolds communicate with oil supply and return lines located externally of the canister. An example of such an oil cooler is shown in Japanese Utility Model Laid Open Publication No. 63-23579 published Feb. 16, 1988.

Where the oil cooler is used in conjunction with an oil filter, the plate pairs are usually in the form of an annulus and a conduit passes through the centre of the annulus delivering oil to or from the filter located above or below the oil cooler and connected to the conduit. The oil can pass through the filter and then the oil cooler, or vice-versa. Examples of such oil coolers are shown in U.S. Pat. No. 4,967,835 issued to Thomas E. Lefeber and U.S. Pat. No. 5,406,910 issued to Charles M. Wallin.

A difficulty with these prior art oil coolers, however, is that they are not particularly efficient. They also often suffer from the disadvantage of high pressure drop on the oil side of the cooler.

The heat exchanger of the present invention is very efficient with relatively low pressure drop. A first exchange fluid travels circumferentially through ringlike plate pairs, and all of a second heat exchange fluid flows between the plate pairs transversely relative to the first heat exchange fluid.

SUMMARY OF THE INVENTION

According to one aspect of the invention, there is provided a heat exchanger which comprises a plurality of stacked plate pairs consisting of face-to-face, mating ringlike plates. Each plate has an outer peripheral flange, an annular inner boss having a portion thereof located in a common plane with the peripheral flange, and an intermediate area located between the peripheral flange and the inner boss. The peripheral flanges and inner bosses in the mating plates are joined together. The intermediate areas have spaced-apart portions to form an inner flow passage between the plates. The plate intermediate areas have spaced-apart intermediate bosses located between the outer peripheral flange and the inner boss that extend from the intermediate area in a direction opposite to the peripheral flange and inner boss. The intermediate bosses define inlet and outlet openings and are arranged such that in back-to-back plate pairs, the intermediate bosses are joined and the respective inlet and outlet openings communicate to define inlet and outlet manifolds for the flow of a first exchange fluid circumferentially through the inner flow passages from the inlet manifold to the outlet manifold. The adjacent intermediate areas in back-to-back plate pairs define outer flow passages therebetween. The outer flow passages extend substially between the inner bosses and the outer peripheral flanges of the respective back-to-back plate pairs. Also, a header encloses one of the inner bosses and outer peripheral flanges. The header includes a flow port for the flow of a second heat exchange fluid therethrough to force the second heat exchange fluid to flow transversely through the outer flow passages between the inner bosses and the outer peripheral flanges.

According to another aspect of the invention, there is provided a method of transferring heat energy between lubricating fluids and engine coolant. The method comprises the steps of providing a plurality of ringlike, closely spaced-apart, stacked plate pairs having inner flow passages therebetween and outer flow passages between the plate pairs. Each plate has an outer peripheral flange, an annual inner boss having a portion there of located in the common plane with the peripheral flange, and an intermediate area located between the peripheral flange and the inner boss. The outer flow passages extend substantially between the inner bosses and the outer peripheral flanges of respective adjacent back-to-back plate pairs. All of one of the fluid and the coolant is passed circumferentially through the plate pairs, and all of the other of the fluid and the coolant is passed transversely between the plate pairs.

BRIEF DESCRIPTION OF THE DRAWINGS

Preferred embodiments of the invention will now be described, by way of example, with reference to the accompanying drawings, in which.

DETAILED DESCRIPTION OF THE PREFERRED EMBODIMENT

Figure 1:
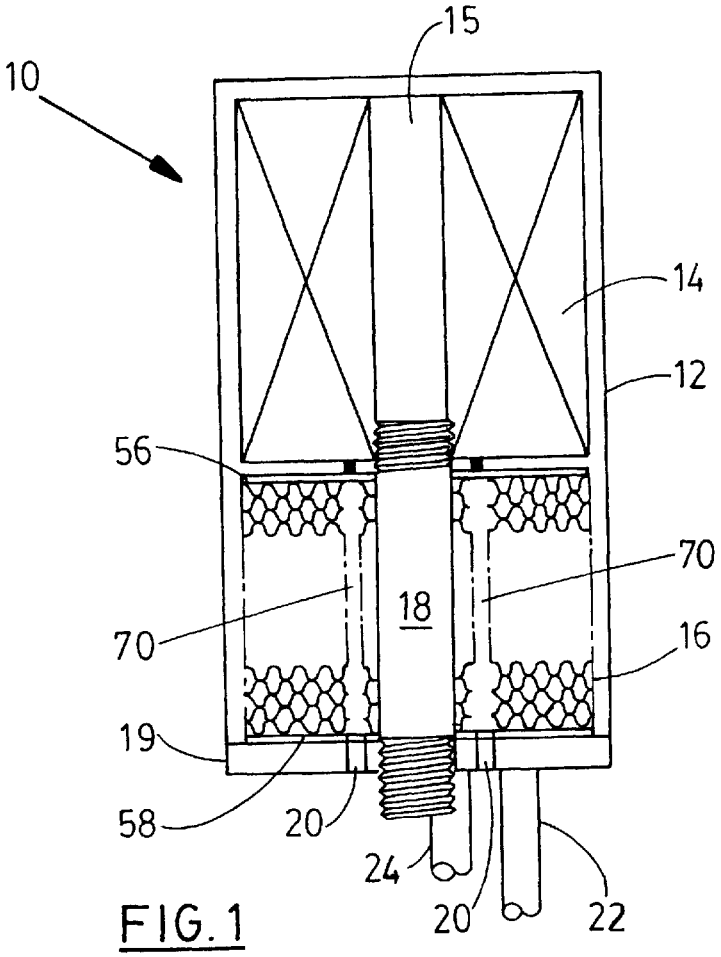
FIG. 1 is a diagrammatic vertical sectional view taken through a first preferred embodiment of a combination heat exchanger and oil filter employing a preferred embodiment of a heat exchanger according to the present invention.
Figure 2:
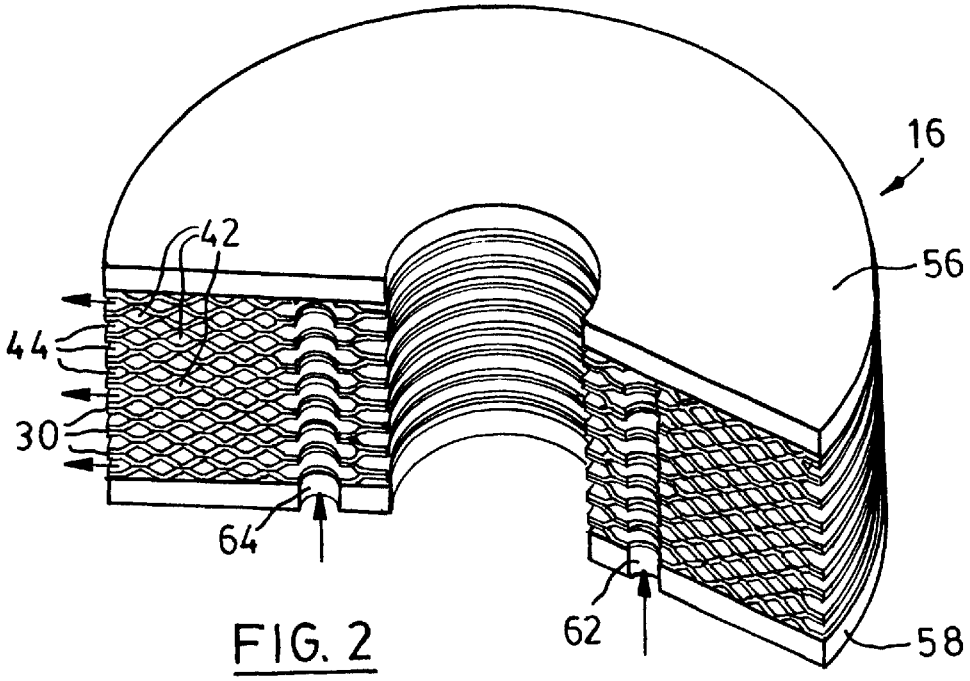
FIG. 2 is an enlarged perspective view, partly broken away, of the heat exchanger employed in the embodiment shown in FIG. 1.
Figure 3:
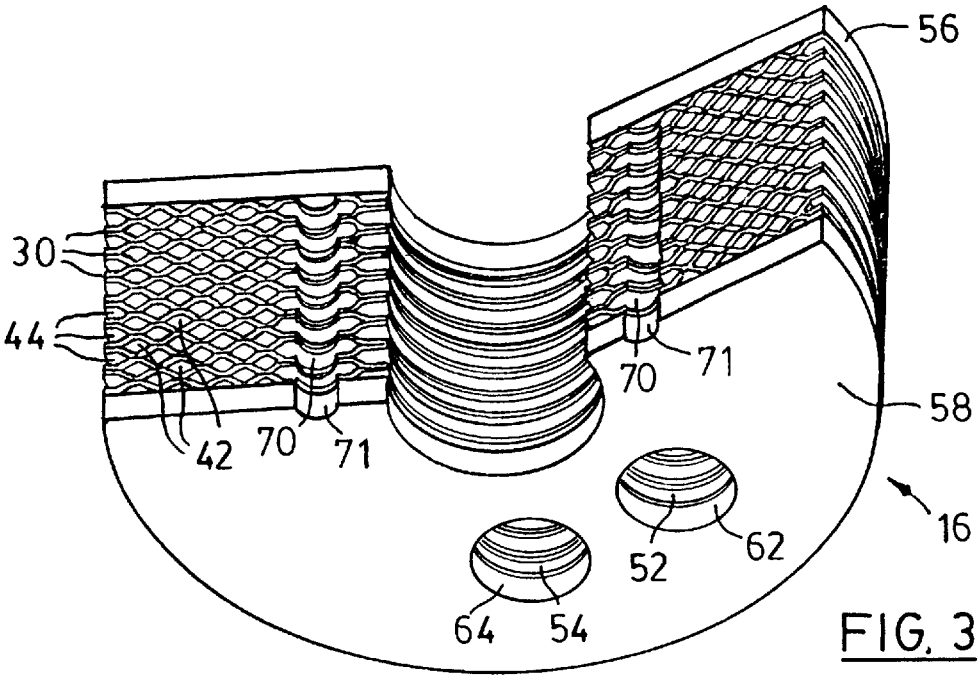
FIG. 3 is an enlarged perspective view similar to FIG. 2, but showing the underside of the heat exchanger of FIG. 2.

Referring firstly to FIG. 1, a preferred embodiment of a combination heat exchanger and oil filter according to the present invention is generally indicated by reference numeral 10. It will be appreciated, however, that any fluid could be used in this invention, not just oil, so the term "oil" shall mean any heat exchange fluid for the purposes of this disclosure. Combination unit 10 includes a housing 12 containing an oil filter 14 and a preferred embodiment of a heat exchanger according to the present invention indicated by reference numeral 16. Oil filter 14 is conventional and is not per se considered to be part of the present invention. Oil filter 14 is of the annular type and in FIG. 1, oil flows from inside the housing inwardly through the filter walls to a central axial chamber 15 and passes downwardly through a pipe or conduit 18 to exit from combination unit 10. However, the oil flow direction could be reversed, so that oil enters through conduit 18 and passes radially outwardly through the filter into housing 12. In the embodiment shown in FIG. 1, oil preferably flows from the housing inwardly through the filter and exits through conduit 18. Heat exchanger 18 will be described in more detail below, but before leaving FIG. 1, it will be noted that housing 12 has a bottom plate 19 containing openings 20 therein for the passage of oil therethrough into heat exchanger 16 depending upon which way it is desired to have the oil flow through filter 14. Conduits 22 and 24 are also attached to bottom plate 19 for the entry and exit of coolant into and out of heat exchanger 16.

Referring next to FIGS. 2 to 6, heat exchanger 16 is formed of a plurality of stacked plate pairs 30 consisting of face-to-face mating, annular or ringlike plates 32. As seen best in FIGS. 4 to 6, each plate 32 has an outer peripheral flange 34, an annular inner boss 36 having a portion 37 located in a common plane with outer peripheral flange 34, and an intermediate area 39 located between peripheral flange 34 and inner boss 36. A plurality of alternating ribs and grooves 38, 40 are formed in intermediate area 39 and extend between the inner boss 36 and the peripheral flange 34. The ribs and grooves 38, 40 are flow augmentation means and are angularly disposed and in the form of spiral or involute curves, so that the ribs and grooves in the respective plates that make up plate pairs 30 cross forming an undulating inner flow passage 42 between the plates of each plate pair 30. Similarly, the ribs and grooves 38, 40 in adjacent back-to-back plate pairs cross forming undulating outer flow passages 44 between the plate pairs 30. Outer flanges 34 contain optional alignment notches 45 to assist in the proper alignment of plates 32 during the assembly of heat exchanger 16. Such alignment notches could be used in all of the embodiments of the present invention, if desired.

Plates 32 have spaced-apart intermediate bosses 46 located between the outer peripheral flange 34 and the inner boss 36 and extending in a direction from the intermediate area 39 in a direction opposite to peripheral flange 34 and inner boss 36. Intermediate bosses 46 define inlet and outlet openings 48, 50. The intermediate bosses 46 are arranged such that in back-to-back plate pairs, the respective inlet and outlet openings 48, 50 are joined around their peripheries to communicate and define inlet and outlet manifolds 52, 54 (see FIG. 3) for the flow of a first heat exchange fluid, such as engine coolant, circumferentially inside or through the inner flow passages of the plate pairs from inlet manifold 52 to outlet manifold 54. The adjacent intermediate areas 39 in back-to-back plate pairs 30 define outer flow passages 44 therebetween. Heat exchanger 16 has top and bottom closure plates 56, 58. Bottom closure plate 58 has openings 62, 64 which register with respective inlet and outlet manifolds 52, 54. Conduits 22, 24 (see FIG. 1) pass through housing bottom plate 19 to communicate with openings 62, 64.

Figure 4:
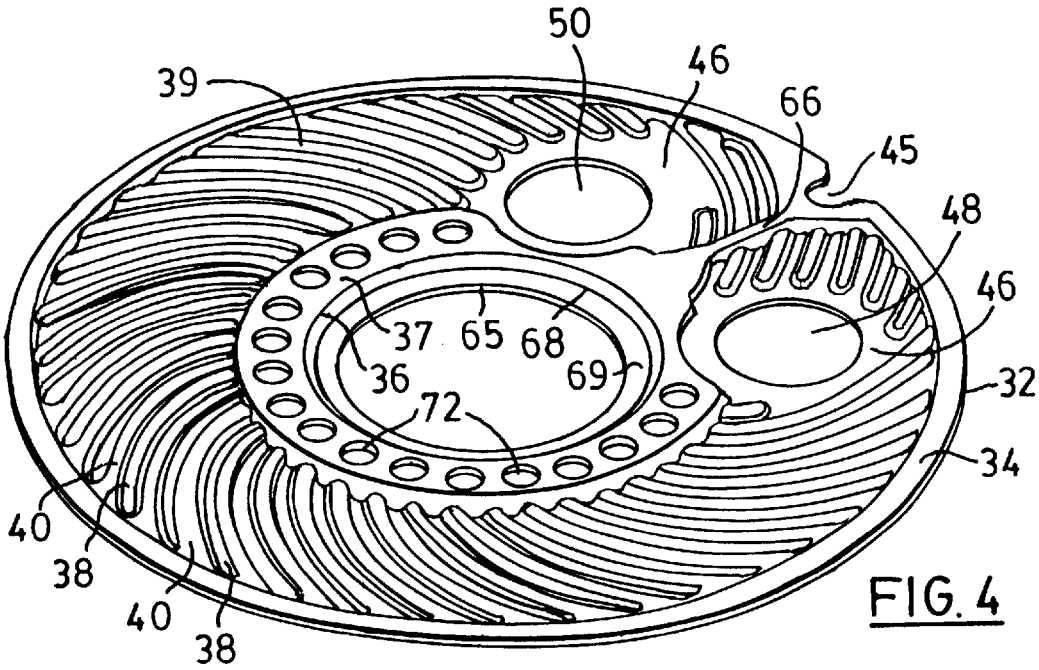
FIG. 4 is an enlarged perspective view showing the inside surface of one of the plates used to form the plate pairs of the heat exchanger embodiment shown in FIGS. 2 and 3.
Figure 6:
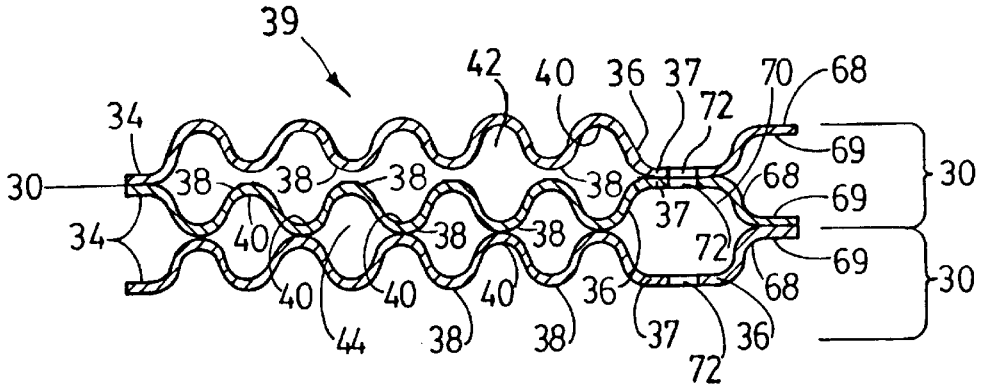
FIG. 6 is a further enlarged sectional view taken along lines 6—6 of FIG. 5 and showing additional plates stacked above and below the plate of FIGS. 4 and 5.

Ribs 38 and grooves 40 have a predetermined height and intermediate bosses 46 have a height, or depth as seen in FIG. 4, that is at least as high as ribs 38, and preferably the same height as ribs 38, so that when the plate pairs are placed back-to-back as seen best in FIG. 6, the ribs 38 on adjacent plates touch as do the outer surfaces of intermediate bosses 46. However, as seen best in FIG. 6, the height of inner annular bosses 36 and outer peripheral flanges 34 is greater than the height of the ribs and grooves, so that the adjacent ribs 38 on the inside of plate pairs 30 are slightly spaced apart. This reduces the water-side pressure drop for the coolant flowing through plate pairs 30.

Since intermediate bosses 46 are located adjacent to one another, a radial rib 66 (see FIGS. 4 and 5) extends between the intermediate bosses 46 from the inner boss 36 to the outer peripheral flange 34. Radial rib 66 is in the same plane as or has the same height as inner boss 36 and outer peripheral flange 34, so that when two plates are put together to form a plate pair 30, the respective radial ribs 66 engage one another to prevent by-pass flow from inlet opening 48 to outlet opening 50. Radial ribs 66 also form radial grooves on the outside or oil side of the plate pairs. These radial grooves improve the radial or transverse flow between the plate pairs near and around intermediate bosses 46.

Inner peripheral flanges 68 are formed on annular inner bosses 36 and have mating flange portions 69 located in a common plane with the intermediate bosses 46, so that the inner peripheral flanges 68 on back-to-back plate pairs are joined together to form, with the inner bosses 36, a header 70 (see FIG. 6) to cause all of the coolant entering inlet opening 62 to flow transversely or radially through the outer flow passages 44 between the back-to-back plate pairs 30.

Inner boss 36 includes a plurality of apertures 72 spaced around inner boss 36. When plate pairs 30 are stacked together, apertures 72 are aligned or in registration to form flow ports for supplying fluid to header 70.

Figure 7:
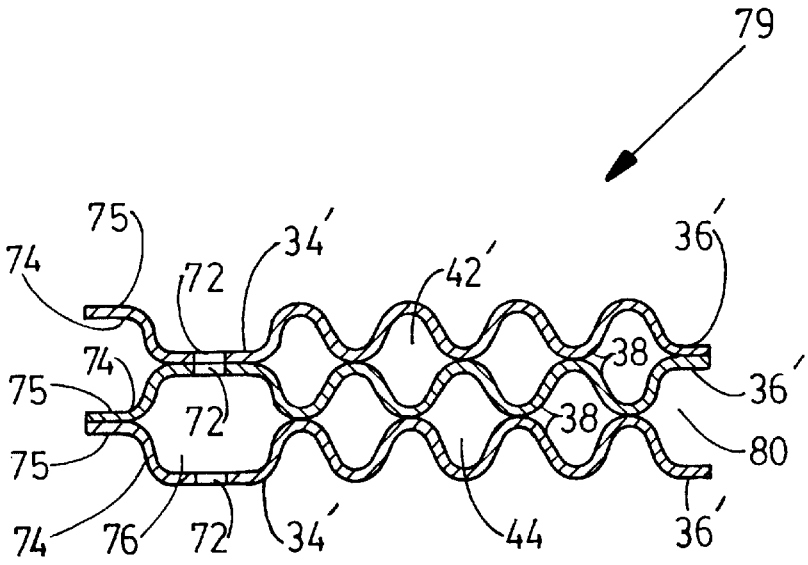
FIG. 7 is a vertical sectional view similar to FIG. 6 but showing another embodiment where the plate header is formed on the outer periphery of the plate pairs.

Referring next to FIG. 7, which is a view similar to FIG. 6, but which shows another embodiment of a heat exchanger 79 according to the present invention having stacked plate pairs that are similar to the embodiment of FIGS. 1 to 6, but where the inner header 70 of FIG. 6 has been eliminated. Primed reference numerals are used in FIGS. 7 to 25 to indicate modified components of the embodiment shown in FIGS. 1 to 6. Inner bosses 36' have been truncated leaving annular slots 80 for the flow of fluid into or out of the outer flow passages 44 between the plate pairs. In this embodiment, outer distal flanges 74 form a header enclosing outer peripheral flanges 34' to cause all of the respective heat exchange fluid to pass transversely or radially between the plate pairs. In this embodiment also, the inner annular boss 36' and outer peripheral flange 34' have a height that is equal to the height of the ribs and grooves, so that the adjacent ribs 38 in inner flow passages 42' are not spaced-apart as in the embodiment shown in FIGS. 1 and 6. However, the adjacent ribs 38 in the inner flow passages 42' could be spaced-apart as in FIG. 6, or the FIG. 6 embodiment could be made like FIG. 7 with ribs 38 not spaced-apart, if desired.

Figure 8:
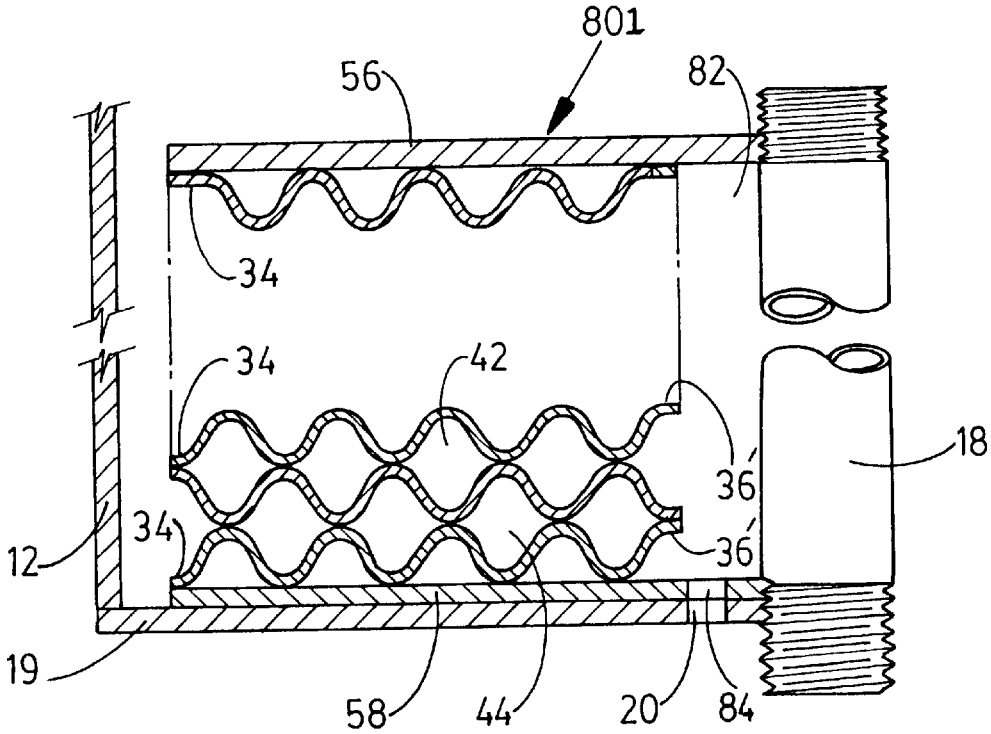
FIG. 8 is an enlarged sectional view of the lower left corner of FIG. 1 showing yet another embodiment of a heat exchanger according to the present invention.

FIG. 8 shows another embodiment of a heat exchanger 801 where a header 82 is formed by the annular space defined by top and bottom closure lates 56, 58 and conduit 18 sealingly engaged therein. Neither the inner bosses 36' nor the outer peripheral flanges 34 have additional flanges formed thereon to form headers. Bottom closure plate 58 includes a flow port 84 for the flow of fluid into or out of header 82.

Figure 5:
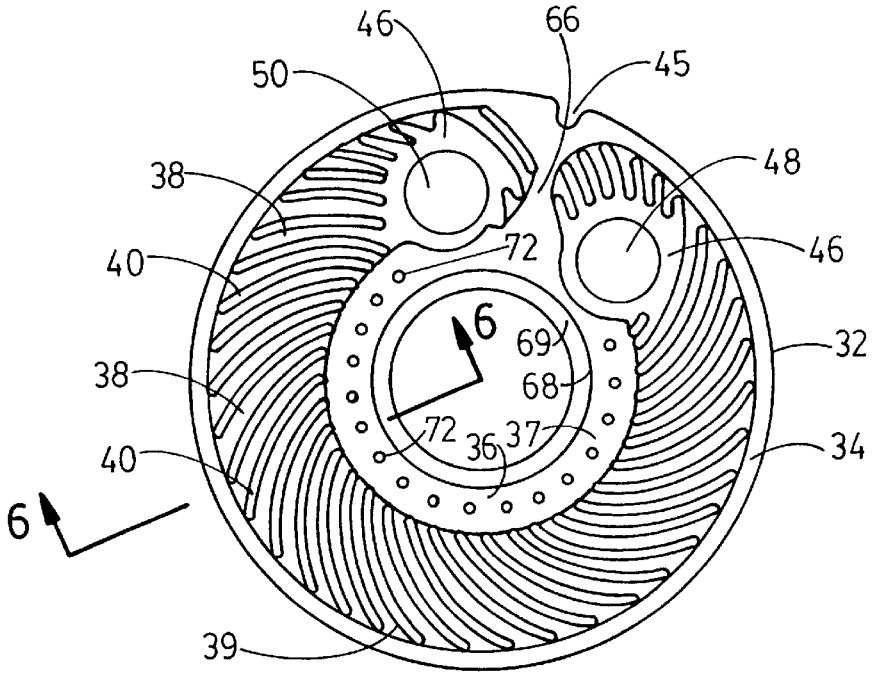
FIG. 5 is a plan view of the plate shown in FIG. 4.
Figure 9:
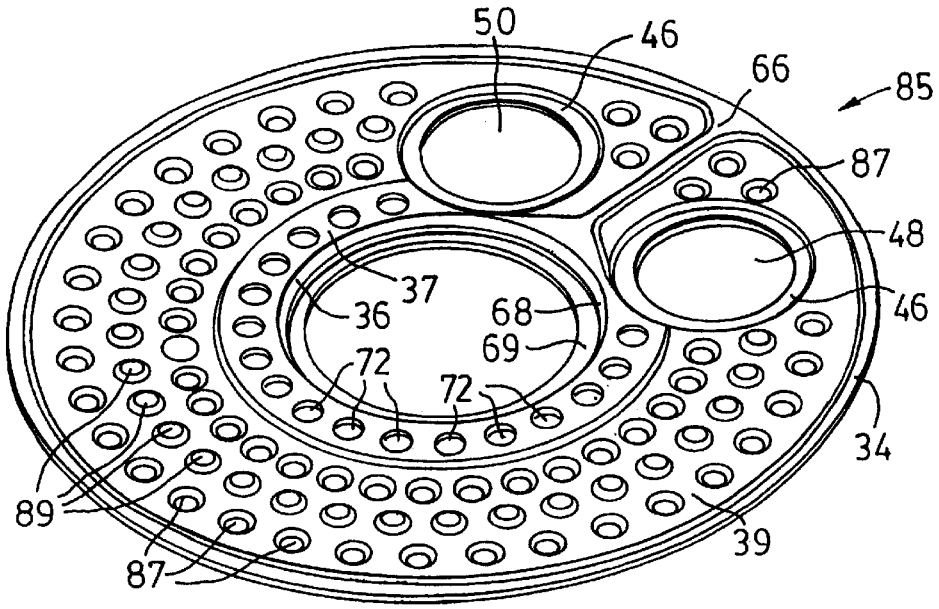
FIG. 9 is a perspective view similar to FIG. 4, but showing another preferred embodiment of a plate used to make a heat exchanger according to the present invention.
Figure 10:
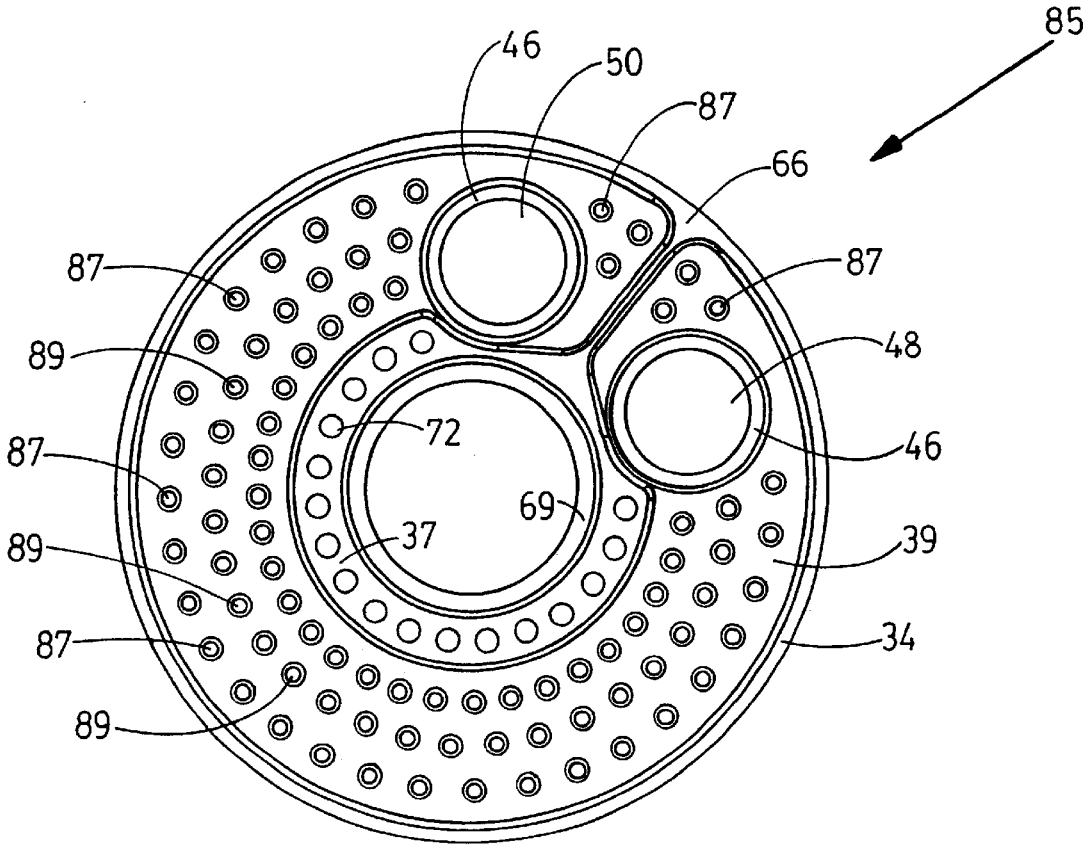
FIG. 10 is a plan view of the plate shown in FIG. 9.

Referring next to FIGS. 9 and 10, another embodiment of a ringlike plate 85 is shown which is similar to plate 32 of FIGS. 4 and 5, but which has a plurality of spaced-apart dimples 87 and 89 formed in the intermediate area 39 as the flow augmentation means instead of ribs 38 and grooves 40. Dimples 87 extend into the outer flow passages 44 and dimples 89 extend into the inner flow passages 42. Dimples 87, 89 have a predetermined height which, in the case of dimples 87, is preferably equal to the height of intermediate bosses 46. However, some or all of the dimples 87 could have a height that is less than intermediate bosses 46.

If desired, plates 85 could be formed with outer distal flanges like flanges 74 in the embodiment shown in FIG. 7 to define headers 76 at the outer periphery of the plates, either in addition to or instead of the inner peripheral flanges 68 and headers 70 as shown in FIG. 6.

Dimples 87 and 89 are shown arranged in respective circumferential rows and generally equi-spaced, but they could be mixed in orientation and spaced apart differently to achieve specific flow effects inside and between the plate pairs.

Figure 11:
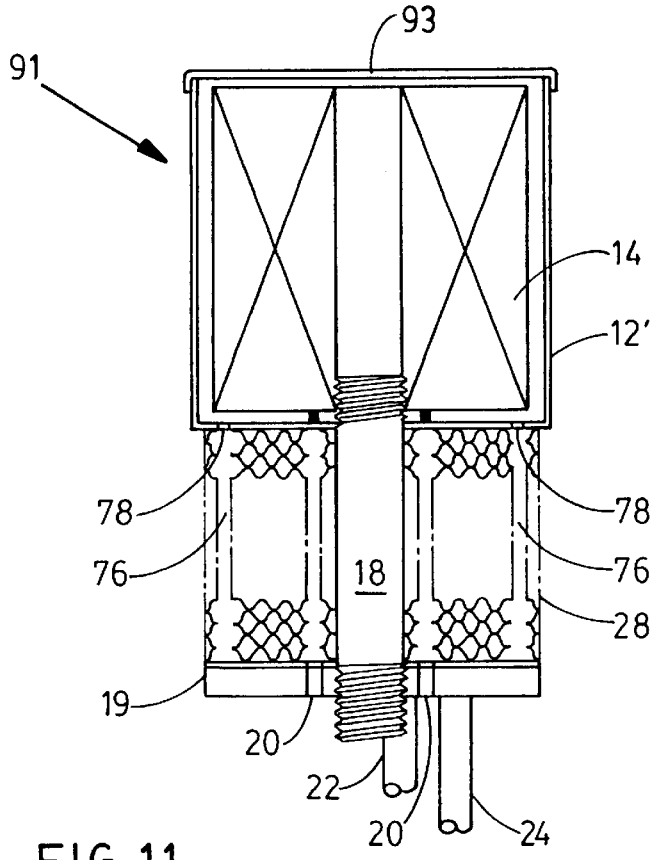
FIG. 11 is a diagrammatic vertical sectional view similar to FIG. 1, but showing another preferred embodiment of a combination heat exchanger and oil filter employing another embodiment of a heat exchanger according to the present invention therein.
Figure 12:
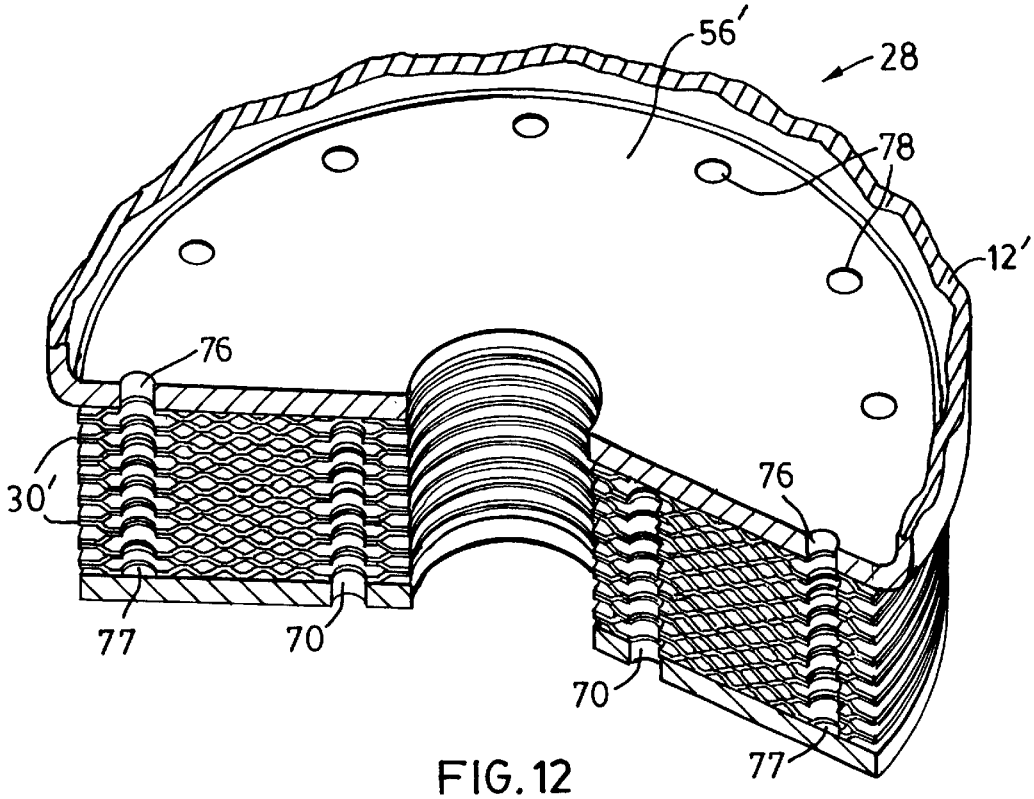
FIG. 12 is an enlarged perspective view, partly broken away, of the heat exchanger employed in the embodiment shown in FIG. 11.
Figure 13:
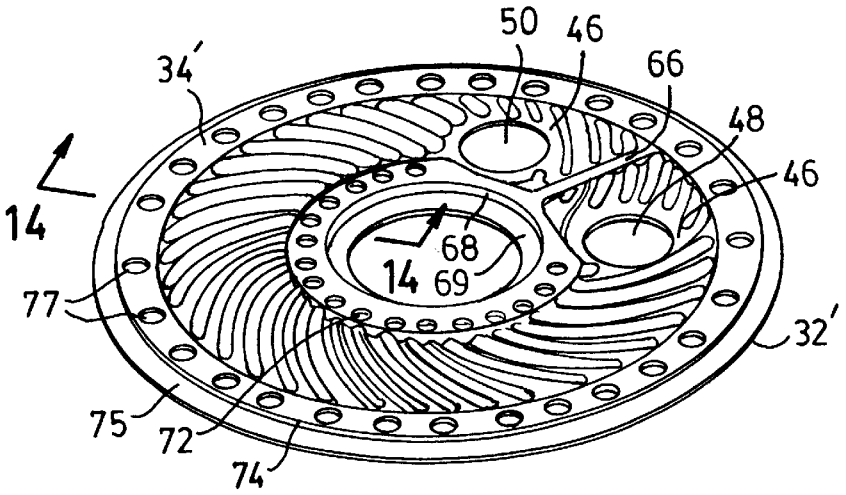
FIG. 13 is a perspective view similar to FIG. 4 but showing the plate used to make the heat exchanger embodiment shown in FIG. 12.
Figure 14:
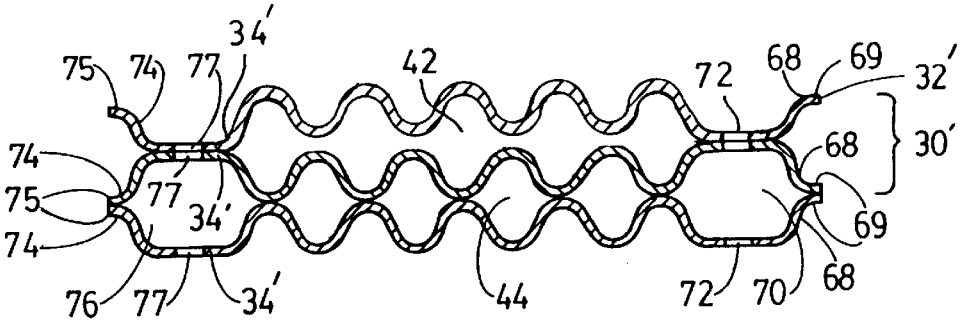
FIG. 14 is a vertical sectional view taken along lines 14—14 of FIG. 13 and showing additional plates stacked above and below the plate of FIG. 13.

FIG. 11 shows another preferred embodiment of a combination heat exchanger and filter 91 which is similar to combination unit 10 of FIG. 1, but which employs a heat exchanger 28 as shown in detail in FIGS. 12 to 14. Top plate 56' in heat exchanger 28 is the bottom wall of housing 12' that contains filter 14, and a removable lid 93 allows for the replacement of filter 14.

Referring in particular to FIGS. 12 to 14, heat exchanger 28 could be considered to be a modification to heat exchanger 16 of FIGS. 2 to 6. In heat exchanger 28, the plates 32' have outer peripheral flanges 34' that have been extended radially, and an outer distal flange 74 is formed on outer peripheral flange 34' having mating flange portions 75. Mating flange portions 75 are located in a common plane with the intermediate bosses 46, so that the distal flanges 74 on back-to-back plate pairs 30' are joined to form, with the outer peripheral flanges 34', a header 76. Apertures 77 are formed in outer peripheral flanges 34' and are aligned in the stacked plate pairs to form flow ports to receive fluid flowing between the back-to-back plate pairs. However, it will be appreciated that the flow direction could be reversed, so that header 76 supplies fluid to flow radially inwardly toward the centre of heat exchanger 28, if desired.

As seen best in FIG. 12, top closure plate 56' is formed with a plurality of openings 78 that communicate with apertures 77 and form part of headers 76 and also communicate with the inside of housing 12'. It will also be appreciated that heat exchanger 28 has two headers 70 and 76 with aligned apertures forming flow ports for these headers.

Figure 15:
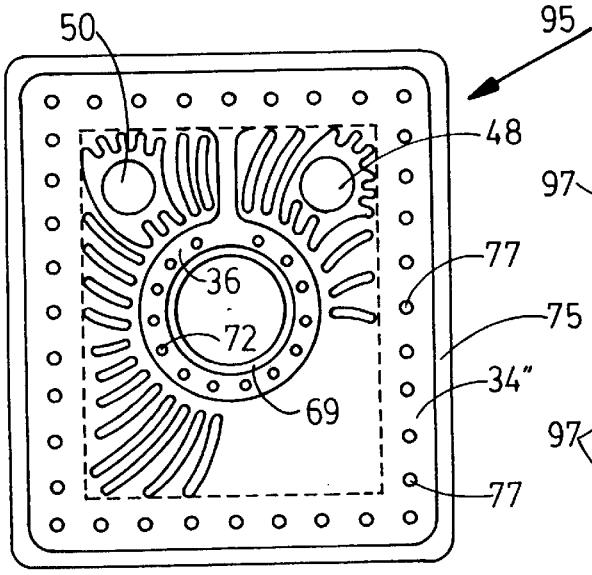
FIG. 15 is a plan view of another preferred embodiment of a ringlike heat exchanger plate used to make a heat exchanger according to the present invention.

FIG. 15 shows a plate 95 that is a modification of plate 32' such that plate 95 is rectangular in shape or plan view. Outer peripheral flange 34" is rectangular as well, and although inner boss 36 is shown to be circular or annular, inner boss 36 could be rectangular as well, if desired. For the purposes of the present specification, plate 95 is still considered to come within the term annular or ringlike, the flow from inlet opening 48 to outlet opening 50 is still considered to be circumferential, and the flow from inner apertures 72 to outer apertures 77 is still considered to be radial or transverse with respect to the circumferential flow inside the plate pairs.

Figure 16:
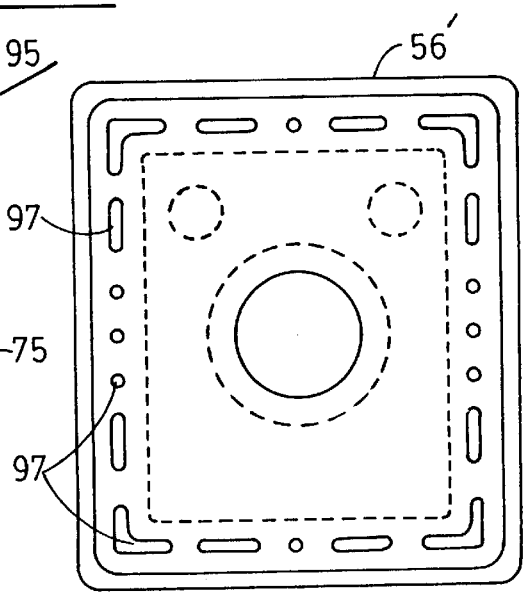
FIG. 16 is a plan view of a top or bottom plate used to make a heat exchanger using the plates shown in FIG. 15.

FIG. 16 shows a modified top plate 56' for use with plates 95. Top plate 56' has peripheral openings 97 that vary in size to obtain uniform flow distribution in the radial or transverse direction. It will be noted that the corner openings 97 are particularly large to increase the flow to the corners of a heat exchanger made with these plates. Alternatively, uniformly sized openings 97 spaced closer or further apart could be used to give a desired flow distribution instead of differently sized apertures 97. These aperture size or shape differences could also be employed in connection with apertures 77 in the core plates 95 of FIG. 15, if desired.

Figure 17:
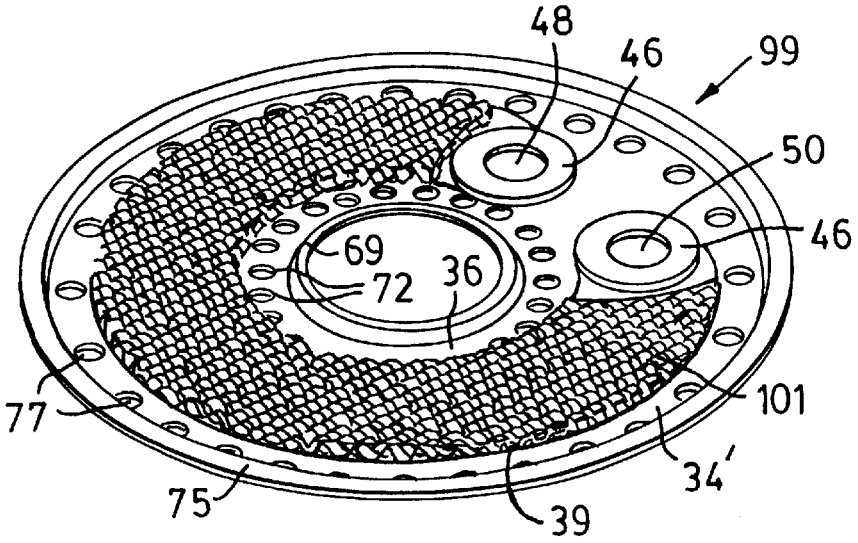
FIG. 17 is a perspective view similar to FIGS. 4 and 9, but showing another embodiment of a plate in combination with a turbulizer as used to make a heat exchanger according to the present invention.

FIG. 17 shows yet another embodiment of a plate 99 used to form a heat exchanger according to the present invention which, like the plate 85 shown in FIGS. 9 and 10, has another type of flow augmentation instead of ribs and grooves as shown in FIGS. 1 to 6 or dimples as shown in FIGS. 9 and 10. In the FIG. 17 embodiment, an expanded metal turbulizer 101 is used as the flow augmentation means. Of course, turbulizer 101 could be formed of other materials than expanded metal, such as plastic mesh. FIG. 17 is a view of plate 99 looking at the oil side or outside of a plate pair. The intermediate areas 39 are located under turbulizer 101 and are still spaced-apart to form inner flow passages inside the plate pairs. Turbulizer 101 could be any type of turbulizer, and if it has a flow resistance that varies in a particular direction, apertures 72 and 77 could be arranged differently or varied in size to suit the turbulizer and maintain uniform radial or transverse flow between the plate pairs. Turbulizers 101 could be employed inside the plate pairs in the inner flow passages as well as, or instead of, the turbulizers 101 used in the outer flow passages as shown in FIG. 17.

Figure 18:
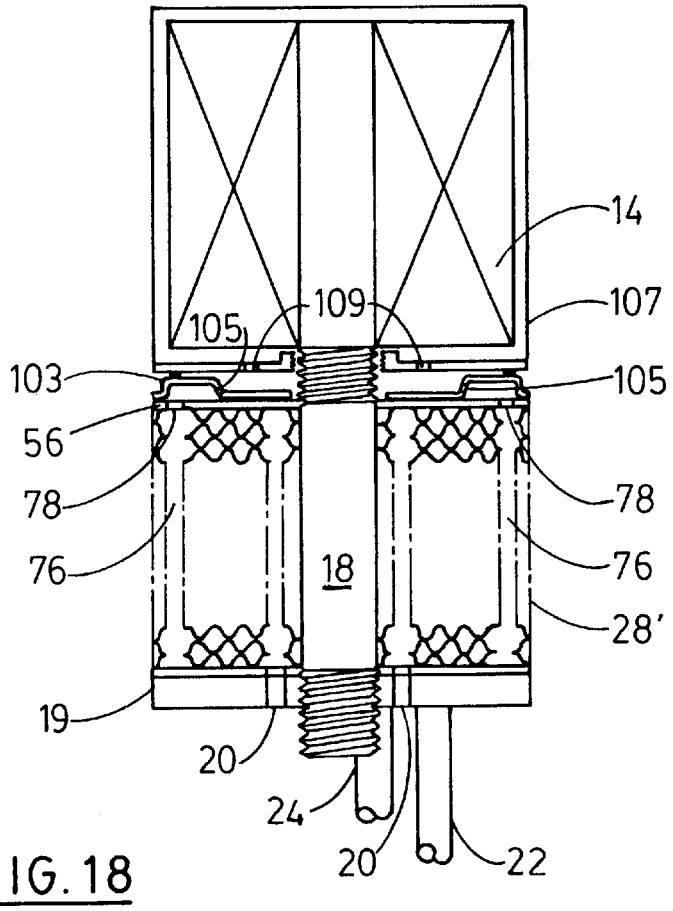
FIG. 18 is a diagrammatic vertical sectional view similar to FIGS. 1 and 11, but showing another preferred embodiment of a heat exchanger as used with a conventional oil filter to make a combination heat exchanger and filter.
Figure 19:
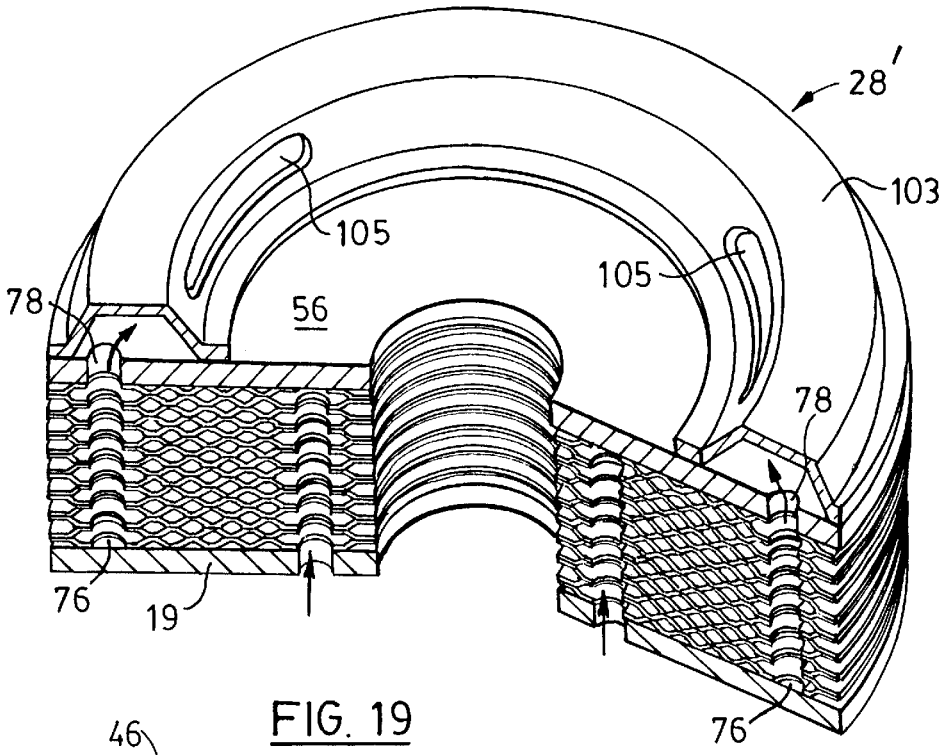
FIG. 19 is an enlarged perspective view, partly broken away, of the heat exchanger shown in FIG. 18.

FIGS. 18 and 19 show a heat exchanger 28' that is a modification to the heat exchanger 28 shown in FIGS. 11 and 12. In heat exchanger 28' an annular filter seat 103 is mounted on top of top closure plate 56 to accommodate a conventional spin-on oil filter 107 that screws onto conduit 18. Filter seat 103 has inner openings 105 to allow fluid emerging from headers 76 or openings 78 to be delivered to filter inlet openings 109.

Figure 20:
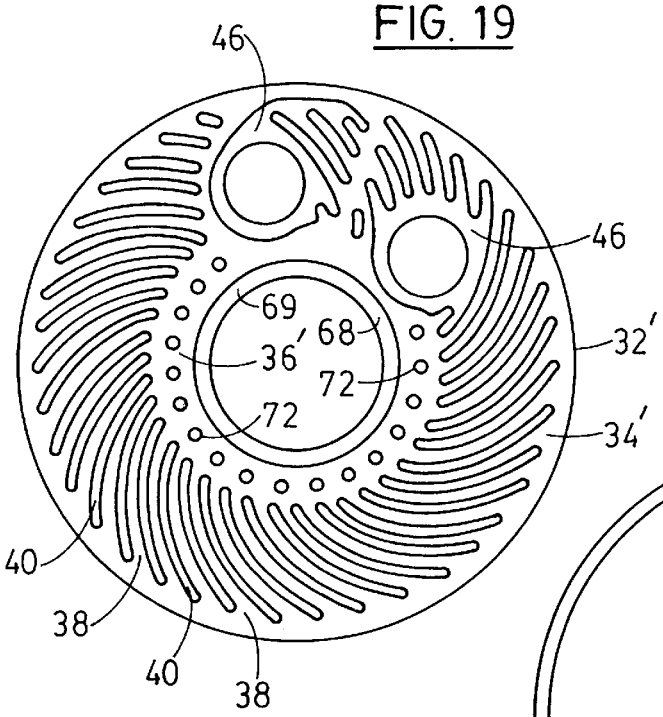
FIG. 20 is a plan view of another embodiment of a plate used to make a heat exchanger according to the present invention.
Figure 21:
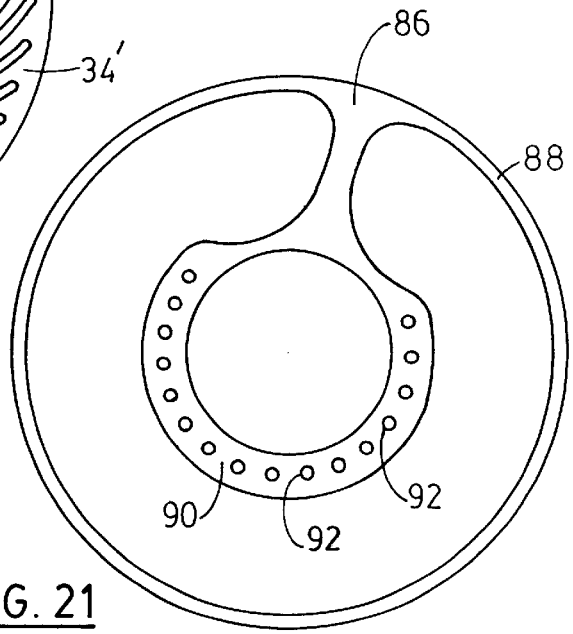
FIG. 21 is a plan view of an optional spacer that may be used with the plates of FIG. 20.

FIG. 20 shows the inside or water side surface of a plate 32' where the inner annular boss 36' and the outer peripheral flange 34' are the same height with respect to both the intermediate bosses 46 and inner peripheral flange 68 as the height of the ribs and grooves 38, 40. If it is desired to reduce the pressure drop inside the plate pairs in this embodiment, a spacer 86 as shown in FIG. 21 can be used between the plates of the plate pairs. Spacer 86 has an outer annular portion 88 which is located between outer peripheral flanges 34' and an inner annular portion 90 which is located between inner annular bosses 36'. Inner annular portion 90 has a plurality of apertures 92 therein to correspond with apertures 72 in inner boss 36'. Rotation of spacer 86 relative to plates 32' causes apertures 92 to act as valves to obtain a predetermined setting or adjustment of the flow through apertures 72 during manufacture of heat exchangers using this type of plate.

Figure 22:
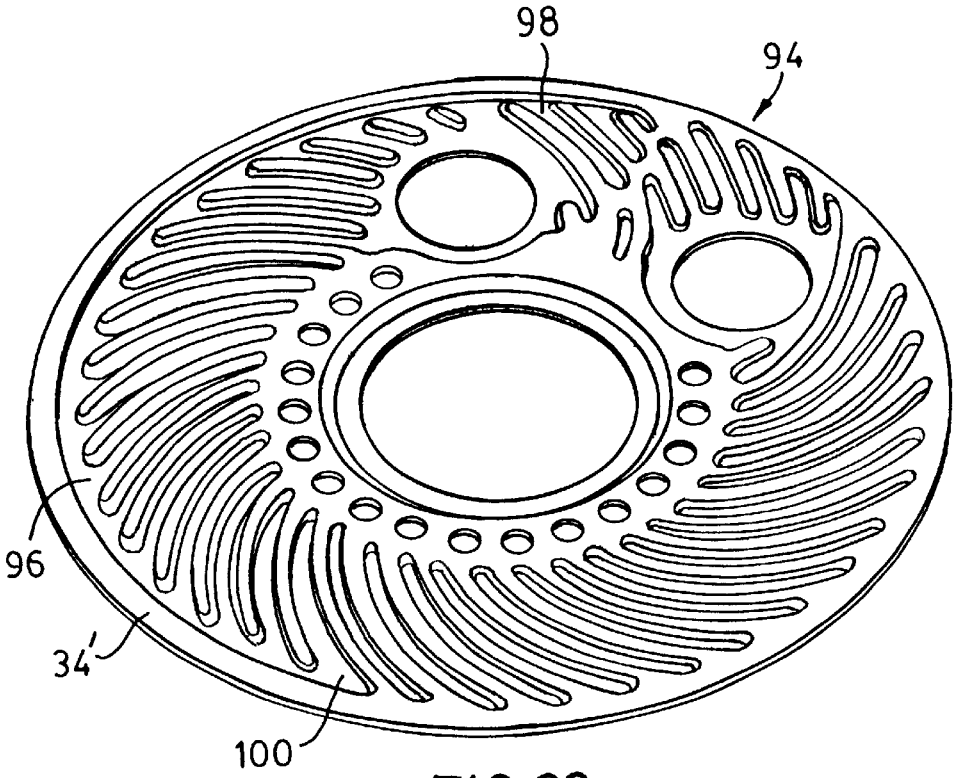
FIG. 22 is a perspective view looking at the inside of another embodiment of a plate used to make a heat exchanger according to the present invention.
Figure 23:
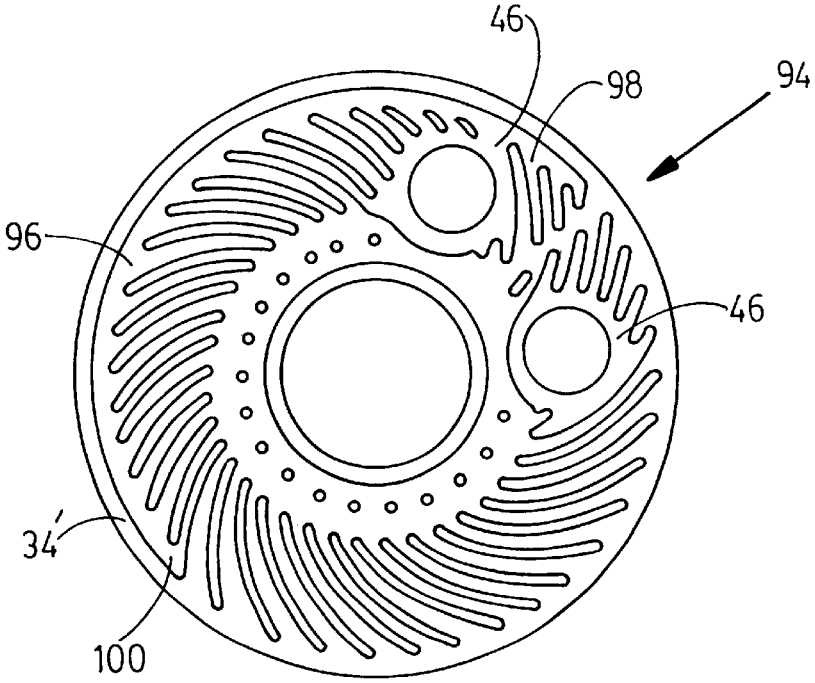
FIG. 23 is a plan view of the plate shown in FIG. 14.

FIGS. 22 and 23 show a plate 94 that is similar to plate 32' of FIG. 20, but which has a peripheral by-pass groove 96 located inside the plate pairs adjacent to the outer peripheral flange 34'. By-pass groove 96 has a first end portion 98 located adjacent to and communicating with one of the intermediate bosses 46 and extends just over half-way around the perimeter of plate 94 to a second end portion 100, so that when two plates 94 are arranged face-to-face, end portions 100 overlap and by-pass groove 96 forms a half-height groove extending all the way around the periphery of the plate pair from one intermediate boss 46 to the other. By-pass groove 96 is used to reduce internal pressure drop inside the plate pairs, if desired.

Figure 24:
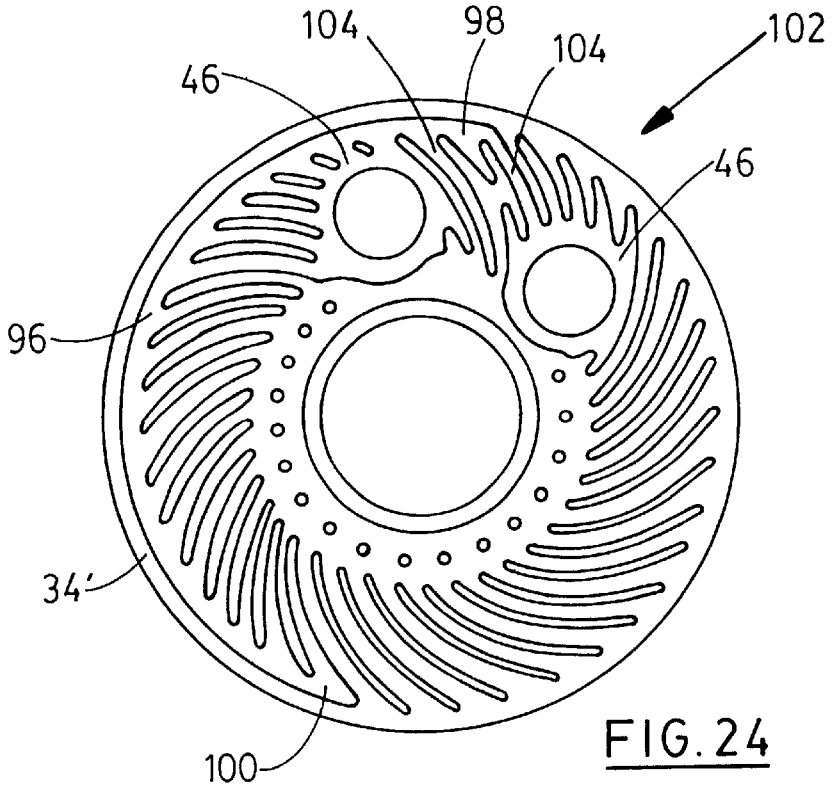
FIG. 24 is a plan view of yet another embodiment of a plate used to make a heat exchanger according to the present invention.

FIG. 24 shows a plate 102 similar to plate 94 of FIG. 23, but having at least one by-pass groove 104 extending between intermediate bosses 46. Actually, because the grooves between intermediate bosses 46 overlap and cross each other, several half-height by-pass channels extend between intermediate bosses 46. Again, these by-pass channels are provided to reduce pressure drop inside the plate pairs. If desired, the by-pass grooves 104 can be used instead of peripheral by-pass groove 96.

Figure 25:
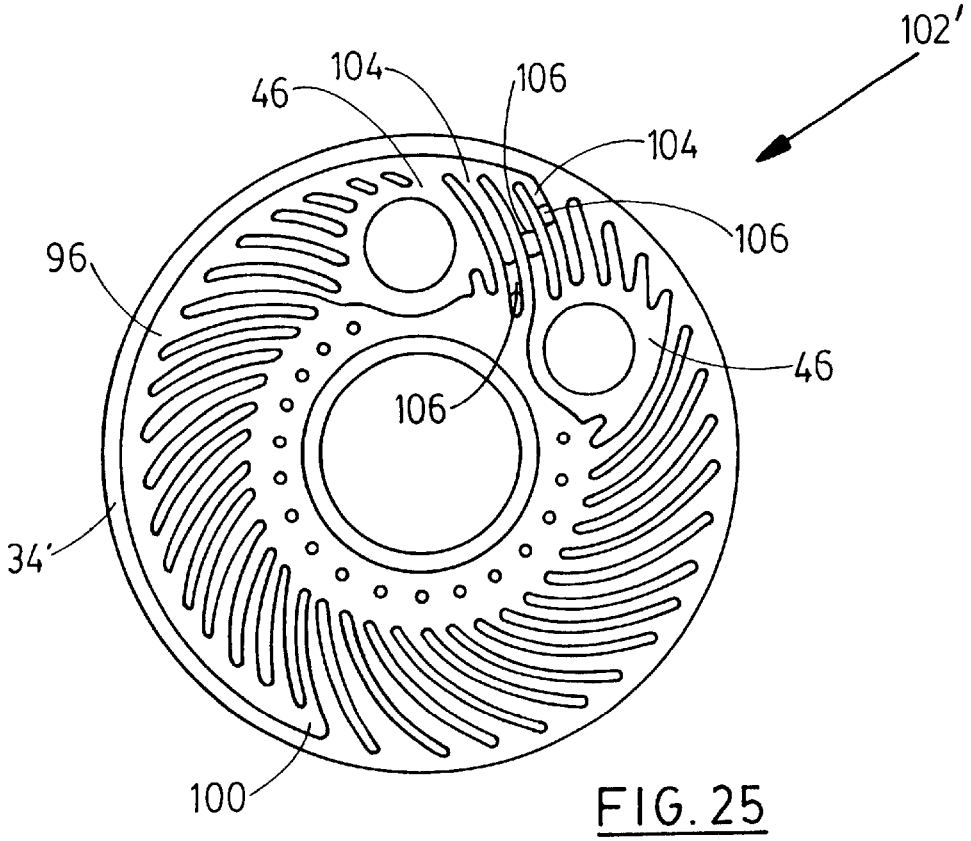
FIG. 25 is a plan view of yet another embodiment of a plate used to make a heat exchanger according to the present invention.

FIG. 25 shows a plate 102' that is a modification of plate 102 of FIG. 24. In plate 102' the by-pass grooves 104 are formed with flow limiting indentations 106 to control or set a predetermined amount of by-pass flow between intermediate bosses 46.

Having described preferred embodiments of the invention, it will be appreciated that various modifications may be made to the structures described above. For example, the intermediate bosses containing the inlet and outlet openings could be made smaller, so that inner annular bosses 36 could be the same width all around their circumference allowing apertures 72 to extend around the full circumference of these bosses. The various heat exchangers can be made using any number of plate pairs and the various plate pair embodiments could be mixed and matched to achieve a particular desired performance. The top and bottom closure plates could be eliminated in certain applications where other means are used to close the various flow manifolds formed by openings in the plates. For example, end plates could be used that are similar to plates used to make the plate pairs, in which case, the various inlet and outlet openings and apertures in these end plates would not be punched out. Other configurations for the ribs and grooves and dimples and turbulizers could also be employed in the plates, if desired.

It will also be appreciated that although the preferred embodiments have been described for use as oil coolers, the heat exchangers of the present invention can be used for cooling or heating other engine fluids, such as, fuel, transmission fluid, hydraulic steering fluid, refrigerant and even engine coolant itself. Either fluid can pass between the plate pairs or through the plate pairs, and the heat exchangers of the present invention can be used to heat fluids as well as cool them. Further, the heat exchangers of the present invention can be used in applications other than in the automotive industry.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A heat exchanger comprising:

a plurality of stacked plate pairs consisting of face-to-face, mating ringlike plates, each plate having an outer peripheral flange, an annular inner boss having a portion thereof located in a common plane with the peripheral flange, and an intermediate area located between the peripheral flange and the inner boss, said peripheral flanges and inner bosses in the mating plates being joined together, the intermediate areas having spaced-apart portions to form an inner flow passage between the plates;

the plate intermediate areas having spaced-apart intermediate bosses located between the outer peripheral flange and the inner boss and extending from the intermediate area in a direction opposite to the peripheral flange and inner boss, the intermediate boss defining inlet and outlet openings and being arranged such that in back-to-back plate pairs, the intermediate bosses are joined and the respective inlet and outlet openings communicate to define inlet and outlet manifolds for the flow of a first exchange fluid circumferentially through the inner flow passages from the inlet manifold to the outer manifold, the adjacent intermediate areas in back-to-back plate pairs defining outer flow passages therebetween, said outer flow passages extending substantially between the inner bosses and the outer peripheral flanges of the respective back-to-back plate pairs; and a header enclosing one of the inner bosses and outer peripheral flanges, the header including a flow port for the flow of a second heat exchange fluid therethrough to force said second heat exchange fluid to flow transversely through said outer flow passages between said inner bosses and said outer peripheral flanges.

2. A heat exchanger as claimed in claim 1 and further comprising flow augmentation means located in one of the inner flow passage and outer flow passage.

3. A heat exchanger as claimed in claim 2 wherein the flow augmentation means comprises the intermediate area being formed with a plurality of alternating ribs and groves extending between the inner boss and the peripheral flange, said ribs and grooves being angularly disposed so that the ribs and grooves in the mating plates cross forming an undulating inner flow passage between the plates, and the ribs and grooves in adjacent back-to-back plate pairs cross forming undulating outer flow passages between the plate pairs.

4. A heat exchanger as claimed in claim 3 wherein the ribs and grooves have a predetermined height, and wherein the intermediate bosses have a height that is at least as high as the rib and groove predetermined height.

5. A heat exchanger as claimed in claim 4 and further comprising an inner peripheral flange formed on the inner bosses and having a mating flange portion located in a common plane with the intermediate bosses, said inner peripheral flanges on back-to-back plate pairs being joined to form with the inner bosses said header, and wherein said port is formed by the inner bosses defining aligned apertures therein.

6. A heat exchanger as claimed in claim 5 and further comprising a housing loosely enclosing the stacked plate pairs, an oil filter located in the housing and having an inlet and an outlet, a conduit passing through the housing and communicating with one of the filter inlet and outlet, and the other of the filter inlet and outlet communicating with the housing interior, the housing defining an oil port communicating with the header port, so that oil passes between the oil port and the interior of the housing.

7. A heat exchanger as claimed in claim 4 wherein the inner boss and outer peripheral flange in each plate have a height that is equal to the height of the ribs and grooves.

8. A heat exchanger as claimed in claim 7 and further comprising a spacer located between the plates of each plate pair, the spacer having an outer peripheral portion located between the outer peripheral flanges and an inner portion located between the inner bosses.

9. A heat exchanger as claimed in claim 4 wherein the inner boss and outer peripheral flange in each plate have a height that is greater than the height of the ribs and grooves.

10. A heat exchanger as claimed in claim 1 wherein said intermediate bosses are located adjacent to one another.

11. A heat exchanger as claimed in claim 10 and further comprising a radial rib extending between the intermediate bosses from the inner boss to the outer peripheral flange, said rib being in said common plane.

12. A heat exchanger as claimed in claim 11 and further comprising the intermediate area defining a peripheral bypass groove located therein inside the plate pairs adjacent to the outer peripheral flanges and extending just over half way around the perimeter of each plate.

13. A heat exchanger as claimed in claim 10 and further comprising at least one bypass rib and groove extending between said intermediate bosses.

14. A heat exchanger as claimed in claim 13 wherein said bypass rib and groove is formed with a flow limiting indentation to produce a predetermined bypass flow.

15. A heat exchanger as claimed in claim 1 and further comprising a housing loosely enclosing the stacked plate pairs, an oil filter located in the housing and having an inlet and an outlet, a conduit passing through the housing and communicating with one of the filter inlet and outlet, and the other of the filter inlet and outlet communicating with the housing interior, the housing defining an oil port communicating with the header port, so that oil passes between the oil port and the interior of the housing.

16. A heat exchanger as claimed in claim 15 wherein the conduit passes axially through the stacked plate pairs, and further comprising top and bottom closure plates attached to the top and bottom of the stacked plate pairs and sealingly engaging the conduit passing therethrough, the closure plates and the conduit forming the header and said flow port being formed in the bottom closure plate.

17. A heat exchanger comprising:

a plurality of stacked plate pairs consisting of face-to-face, mating ringlike plates, each plate having an outer peripheral flange, an annular inner boss having a portion thereof located in a common plane with the peripheral flange, and an intermediate area located between the peripheral flange and the inner boss, said peripheral flanges and inner bosses in the mating plates being joined together, the intermediate areas having spaced-apart portions to form an inner flow passage between the plates;

the plate intermediate areas having spaced-apart intermediate bosses located between the outer peripheral flange and the inner boss and extending from the intermediate area in a direction opposite to the peripheral flange and inner boss, the intermediate boss defining inlet and outlet openings and being arranged such that in back-to-back plate pairs, the intermediate bosses are joined and the respective inlet and outlet openings communicate to define inlet and outlet manifolds for the flow of a first exchange fluid circumferentially through the inner flow passages from the inlet manifold to the outer manifold, the adjacent intermediate areas in back-to-back plate pairs defining outer flow passages therebetween, said outer flow passages extending substantially between the inner bosses and the outer peripheral flanges of the respective back-to-back plate pairs; and a header enclosing one of the inner bosses and outer peripheral flanges, the header including a flow port for the flow of a second heat exchange fluid therethrough to force said second heat exchange fluid to flow transversely through said outer flow passages between said inner bosses and said outer peripheral flanges;

wherein an outer distal flange is formed on the outer peripheral flange and has a mating flange portion located in a common plane with the intermediate bosses, said outer distal flanges on back-to-back plate pairs being joined to form, with the outer peripheral flanges, said header, and wherein said port is formed by the outer peripheral flange defining aligned apertures therein.

18. A heat exchanger as claimed in claim 17 and further comprising a filter having a housing defining an inlet and an outlet, the filter being attached to the stacked plate pairs with one of the filter inlet and outlet communicating with said port.

19. A heat exchanger comprising;

a plurality of stacked plate pairs consisting of face-to-face, mating ringlike plates, each plate having an outer peripheral flange, an annular inner boss having a portion thereof located in a common plane with the peripheral flange, and an intermediate area located between the peripheral flange and the inner boss, said peripheral flanges and inner bosses in the mating plates being joined together, the intermediate areas having spaced-apart portions to form an inner flow passage between the plates;

the plate intermediate areas having spaced-apart intermediate bosses located between the outer peripheral flange and the inner boss and extending from the intermediate area in a direction opposite to the peripheral flange and inner boss, the intermediate boss defining inlet and outlet openings and being arranged such that in back-to-back plate pairs, the intermediate bosses are joined and the respective inlet and outlet openings communicate to define inlet and outlet manifolds for the flow of a first exchange fluid circumferentially through the inner flow passages from the inlet manifold to the outer manifold, the adjacent intermediate areas in back-to-back plate pairs defining outer flow passages therebetween, said outer flow passages extending substantially between the inner bosses and the outer peripheral flanges of the respective back-to-back plate pairs;

a header enclosing one of the inner bosses and outer peripheral flanges, the header including a flow port for the flow of a second heat exchange fluid therethrough to force said second heat exchange fluid to flow transversely through said outer flow passages between said inner bosses and said outer peripheral flanges;

an inner peripheral flange formed on the inner bosses and having a mating flange portion located in a common plane with the intermediate bosses, said inner peripheral flanges on back-to-back plate pairs being joined to form with the inner bosses said header; and an outer distal flange formed on the outer peripheral flanges, and having a mating flange portion located in a common plane with the intermediate bosses, said distal flanges on back-to-back plate pairs being joined to form a second header and wherein said port is defined by the inner bosses having aligned apertures therein and the outer peripheral flanges have aligned apertures forming a second port for said second header.

20. A heat exchanger as claimed in claim 19 wherein each of the plates includes a plurality of said apertures spaced around the inner boss.

21. A heat exchanger comprising:

a plurality of stacked plate pairs consisting of face-to-face, mating ringlike plates, each plate having an outer peripheral flange, an annular inner boss having a portion thereof located in a common plane with the peripheral flange, and an intermediate area located between the peripheral flange and the inner boss, said peripheral flanges and inner bosses in the mating plates being joined together, the intermediate areas having spaced-apart portions to form an inner flow passable between the plates;

the plane intermediate areas having spaced-apart intermediate bosses located between the outer peripheral flange and the inner boss and extending from the intermediate area in a direction opposite to the peripheral flange and inner boss, the intermediate bosses defining inlet and outlet openings and being arranged such that in back-to-back plate pairs, the intermediate bosses are joined and the respective inlet and outlet openings communicate to define inlet and outlet manifolds for the flow of a first exchange fluid circumferentially through the inner flow passages from the inlet manifold to the outer manifold, the adjacent intermediate areas in back-to-back plate pairs defining outer flow passages therebetween, said outer flow passages extending substantially between the inner bosses and the outer peripheral flanges of the respective back-to-back plate pairs;

a header enclosing- one of the inner bosses and outer peripheral flanges, the header including a flow port for the flow of a second heat exchange fluid therethrough to force said second heat exchange fluid to flow transversely through said outer flow passages; and flow augmentation means located in one of the inner flow passage and outer flow passage, wherein the plates are rectangular in shape.

22. A method of transferring heat energy between lubricating fluids and engine coolant, comprising the steps of:

providing a plurality of ringlike, closely spaced, stacked plates having inner flow passages therebetween and outer flow passages between the plate pairs, each plate having an outer peripheral flange, an annular inner boss having a portion thereof located in a common plane with the peripheral flange and an intermediate area located between the peripheral flange and the inner boss, said outer flow passages extending substantially between the inner bosses and the outer peripheral flanges of respective adjacent back-to-back plate pairs;

passing all of one of the fluid and the coolant circumferentially through the inner flow passages formed by the plate pairs; and passing all of the other of the fluid and the coolant transversely through the outer flow passages located between the plate pairs.

23. A method of transferring heat energy as claimed in claim 22 wherein the fluid or coolant is passed transversely between the plate pairs by providing a header communicating with all of the outer flow passages between the plate pairs, the header being located at one of the center and outer periphery of the stacked plate pairs, so that all of the respective fluid or coolant passes transversely through the plate pairs.

24. A method of transferring heat energy as claimed in claim 22 wherein the coolant passes circumferentially through the plate pairs and the fluid passes transversely between the plate pairs.

* * * * *